US005255906A

United States Patent [19]

Ballard et al.

[11] Patent Number: 5,255,906

[45] Date of Patent: Oct. 26, 1993

[54] DOCUMENT REGISTRATION APPARATUS

[75] Inventors: Michael D. Ballard, Sandy Hook; Sandra Graveson, Waterbury; Joseph H. Marzullo, Brookfield; Curtis Mrozinski, Newtown, all of Conn.

[73] Assignee: Pitney Bowes Inc., Stamford, Conn.

[21] Appl. No.: 808,863

[22] Filed: Dec. 17, 1991

[51] Int. Cl.[5] ..... B65H 9/04

[52] U.S. Cl. ..... 271/246; 414/789

[58] Field of Search ..... 271/245, 246; 414/789; 198/463.4, 434

[56] References Cited

U.S. PATENT DOCUMENTS

| | | | |
|---|---|---|---|
| 824,755 | 10/1906 | Sturtevant . | |
| 3,186,325 | 6/1965 | Belder | 271/246 X |
| 3,637,203 | 1/1972 | French | 271/53 |
| 3,661,383 | 5/1972 | Morrison | 271/51 |
| 4,073,391 | 2/1978 | O'Brien et al. | 271/246 X |
| 4,078,790 | 3/1978 | Stocker | 271/213 |
| 4,533,135 | 8/1985 | Barker | 271/275 |
| 4,570,923 | 2/1986 | Hooper et al. | 271/275 |
| 4,606,536 | 8/1986 | Ohara | 271/118 |
| 4,630,815 | 12/1986 | Petersen et al. | 271/273 |
| 4,750,853 | 6/1988 | Van Soest et al. | 414/43 |
| 4,815,726 | 3/1989 | Pagowski et al. | 271/274 |
| 5,080,347 | 1/1992 | Funada | 271/246 X |

FOREIGN PATENT DOCUMENTS

| | | | |
|---|---|---|---|
| 0280150 | 12/1987 | Japan | 271/246 |
| 0171738 | 7/1988 | Japan | 271/246 |

*Primary Examiner*—Robert P. Olszewski
*Assistant Examiner*—Carol Lynn Druzbick
*Attorney, Agent, or Firm*—Charles R. Malandra, Jr.; Melvin J. Scolnick

[57] ABSTRACT

A document registration apparatus for use in a document inserting station or a document queuing station is provided. The apparatus includes a document registration unit having a plurality of laterally-spaced registration stops for stopping motion of a document and registering a particular edge of a document to a particular direction in the apparatus. The registration unit also includes at least one non driver urge roller for moving the registered document away from the apparatus for further processing. The document registration apparatus also includes a jam access hinge for providing access to a jammed document.

14 Claims, 10 Drawing Sheets

DOCUMENT REGISTRATION APPARATUS

BACKGROUND OF THE INVENTION

The present invention relates to a document registration apparatus for use in a document processing system, and more particularly, for use in a document inserting station or a document queuing station.

Various document processing systems require that a particular edge of a processed document is aligned relative to a particular direction in the system. For example, enclosures which are to be inserted into an envelope should be aligned relative to the envelope prior to insertion in order to avoid processing difficulties. Furthermore, some documents which are to be transported away from a particular queuing station, to another adjacent document raceway, should be aligned at the queuing station relative to the raceway, in order to facilitate the processing of the documents.

Devices which register a particular edge of a document to a particular direction are known. However, these devices may suffer from a number of drawbacks. For example, some of these devices are subject to frequent mechanical failure because of the complex nature of their mechanical design. Document registration devices should be able to repeatedly process a great number of documents before repair or replacement is necessary.

Another drawback present in some known document registration devices is that it can be difficult to adjust the device to the proper alignment. In some designs which have multiple parts, for example, each of the individual parts must be aligned relative to each other in order for the overall apparatus to be properly aligned to a particular chosen direction. Furthermore, when the number of parts is large, alignment can also be time consuming.

A document registration apparatus which simultaneously aligns a stack of documents can also suffer from drawbacks associated with the mechanical design of the apparatus. For example, the method of removing the stack of aligned documents from some document registration apparatuses have resulted in undesirable "shingling" of documents where the top document in the stack is not directly above the lower documents but slightly shifted forward or backward. This can occur, for example, in some queuing stations when the exit pinch rollers are mounted in such a way that requires that the bulk of the queuing station to substantially move when a document stack exits the station.

In light of the above, it would be desirable to be able to provide a document registration apparatus which is not subject to frequent mechanical failure because of the nature of its mechanical design.

It would also be desirable to provide such a document registration apparatus where the number of mechanical parts is kept to a minimum.

It would further be desirable to provide such a document registration apparatus that is not difficult to adjust for proper alignment.

It would still further be desirable to provide a document registration apparatus which can simultaneously align a stack of documents without undesirable shingling of the documents when the documents exit the apparatus.

Additionally, it would be desirable to provide a document registration apparatus which allows easy access to jammed documents for removal thereof.

SUMMARY OF THE INVENTION

It is an object of this invention to provide a document registration apparatus which is not subject to frequent mechanical failure because of the nature of its mechanical design.

In accordance with the present invention there is provided a document registration apparatus for use with a conveying means for transporting a document along a path from an upstream direction to a downstream direction through a document registration position. The document registration apparatus includes a document registration unit positioned above the document path adjacent to the document registration position, having an upstream end, a downstream end and a pivoting axis positioned in between the upstream end and the downstream end, a plurality of laterally-spaced registration stops at the downstream end of the unit positioned substantially perpendicularly to the document path for both stopping a document at the document registration position and for aligning the document relative to the document path when the downstream end of the unit is pivoted adjacent to the document path, and at least one non driver urge roller at the upstream end of the unit for urging a stopped document against the conveying means when the upstream end of the unit is pivoted adjacent to the document path to move the document from the document registration position in the downstream direction. The apparatus also has a pivoting means for pivoting the unit about its pivoting axis for selectively moving one of the upstream end and the downstream end into a position adjacent to the document path. The document registration further comprises a jam access means for allowing movement of the registration unit away from the conveying means to provide access to a jammed document at the document registration position for removal thereof.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
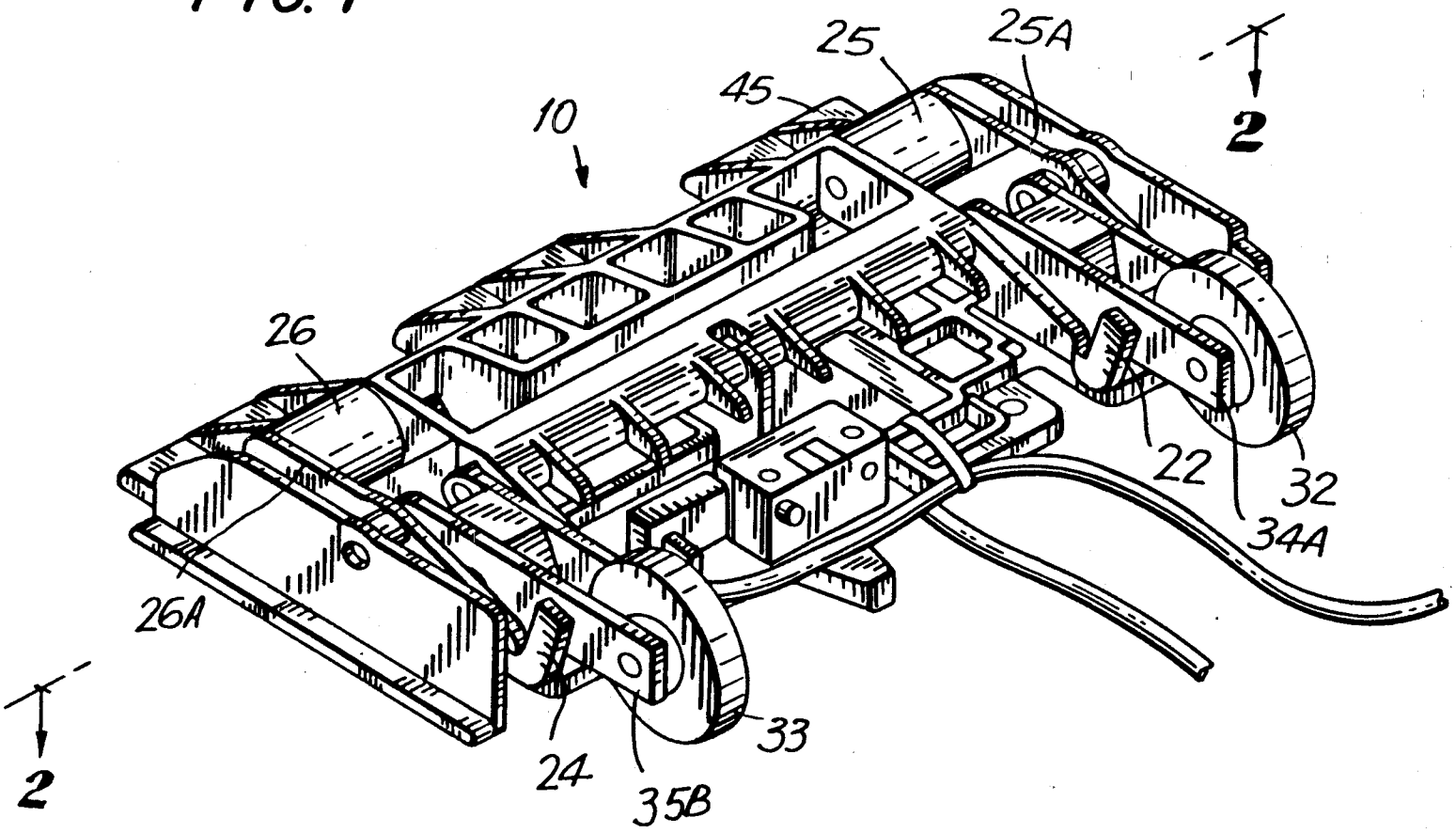
FIG. 1 is a bottom perspective view of the preferred embodiment of the document registration apparatus according to the present invention.

A first preferred embodiment 10 of the document registration apparatus according to the present invention will be discussed with reference to FIGS. 1-9. With reference to FIGS. 1-9 and in particular FIG. 7, document registration apparatus 10 of the present invention is used in conjunction with a document conveyor system 11 which transports a document 12 along a path 13 from an upstream position to a downstream position in the direction of arrow D. Positioned between the upstream position and the downstream position is a document registration position 16 where a document 12 is stopped in its path and is held or queued until the processing system of which conveyor system 11 is a part is ready to process document 12. At the same time, document 12 is aligned in accordance with the present invention. Document registration apparatus 10 aligns document 12 relative to path 13, or, if desired, some other document raceway in the system. Although FIG. 7 shows a single document 12, it is to be understood that the present invention is applicable to situations where document 12 is a stack of documents. Document registration unit 20 includes four registration stops 21, 22, 23 and 24 on the downstream end there of and two non driver urge rollers 25 and 26 on urge roller arms 25A-B and 26A-B, respectively, on the upstream end of unit 20. Non driver urge rollers 25 and 26 are spaced at lateral positions between the lateral positions of registration stops 21 and 22 on the one hand, and the lateral positions of registration stops 23 and 24 on the other hand, respectively (see FIG. 2). Unit 20 pivots around pivot axis 31. A rotary solenoid 27 is linked to a pivoting arm 14 by a pin 28 which rides in a slot 15 of pivoting arm 14. Pin 28 moves along a circular path on each actuation of solenoid 27 and reciprocates in slot 15, thereby rocking pivot arm 14. As pivot arm 14 rocks, document registration unit 20 pivots around pivot axis 31.

In accordance with the present invention, the combination of registration stops 21-24 and non driver urge rollers 25 and 26 are used to stop and align document 12 at document registration position 16, and then to release it for further processing. The stopped document 12 is aligned at this position so that it can subsequently be processed with minimal skew relative to path 13 or, if desired, some other document raceway as discussed above. For example, if document 12 is an envelope to which enclosures will be inserted, then registration stops 21-24 ensure that the envelope will be aligned relative to the enclosures. This insertion process can take place at document registration position 16 (where the envelope will be held open by an envelope opening claw) or, if desired, at a subsequent location along path 13. Similarly, if document 12 is an enclosure which will be subsequently inserted into an envelope, then registration stops 21-24 ensure that the enclosure will be aligned relative to the envelope.

In order to stop document 12 at document registration position 16, document registration unit 20 is normally urged clockwise to position A (FIG. 7) by actuating solenoid 27. In position A, registration 21-24 extend into document path 13 and preferably project below the plane of conveyor system 11, so as to block document 12 from being transported further downstream by conveyor system 11. In the preferred embodiment, conveyor system 11 includes two conveyor belts 11A and 11B (see FIG. 8) which move in synchronization. Preferably, conveyor belts 11A and 11B are each approximately 0.5 inch wide. Laterally spaced on each side of each conveyor belt 11A and 11B are registration stops 21, 22 and 23, 24, respectively. The projection of stops 21-24 below the plane of conveyor system 11 assures that document 12 cannot slip through. Registration stops 21-24 are laterally-spaced along document registration unit 20 so that when document 12 is stopped at document registration position 16, the downstream edge 49 (see FIGS. 7 and 8) of document 12 is aligned with respect to document path 13 or, if desired, any other path with which it is desired to align document 12. The continued travel of conveyor system 11 while document 12 is stopped assures that document 12 registers completely against stops 21-24. When it is time to release document 12, solenoid 27 is actuated to pivot unit 20 to position B (FIG. 7) where non driver urge rollers 25 and 26 urge document 12 against conveyor system 11, thus increasing the frictional force between document 12 and conveyor system 11. The increased frictional force is enough to stop the slippage between document 12 and conveyor system 11 and moves document 12 downstream for further processing.

As document 12 moves in the downstream direction, it encounters exit pinch rollers 32 and 33 which are mounted on independent sets of support arms 34A, 34B and 35A, 35B, corresponding to exit pinch rollers 32 and 33, respectively, and which pivot about pivoting axis 31. Arms 34A, 34B and 35A, 35B and thus rollers 32 and 33, are respectively spring biased by separate torsion springs (not shown) to urge rollers 32 and 33 against conveyor system 11. Rollers 32 and 33 move away from conveyor system 11 when a document is released, but move back into engagement with conveyor system 11—and the released document—as soon as unit 20 closes again to hold the next document. The released document is thus urged against conveyor system 11 and driven while the next document is held. The mounting of rollers 32 and 33 on separate support arms 34A, 34B and 35A, 35B results in minimal "shingling" of documents when a stack of documents exit the document registration apparatus. This is because rollers 32 and 33 and sets of arms 34A, 34B and 35A, 35B can move away from conveyor system 11 as required by the thickness of document 12 to allow document 12 to pass, without lifting the remainder of unit 20.

Figure 4:
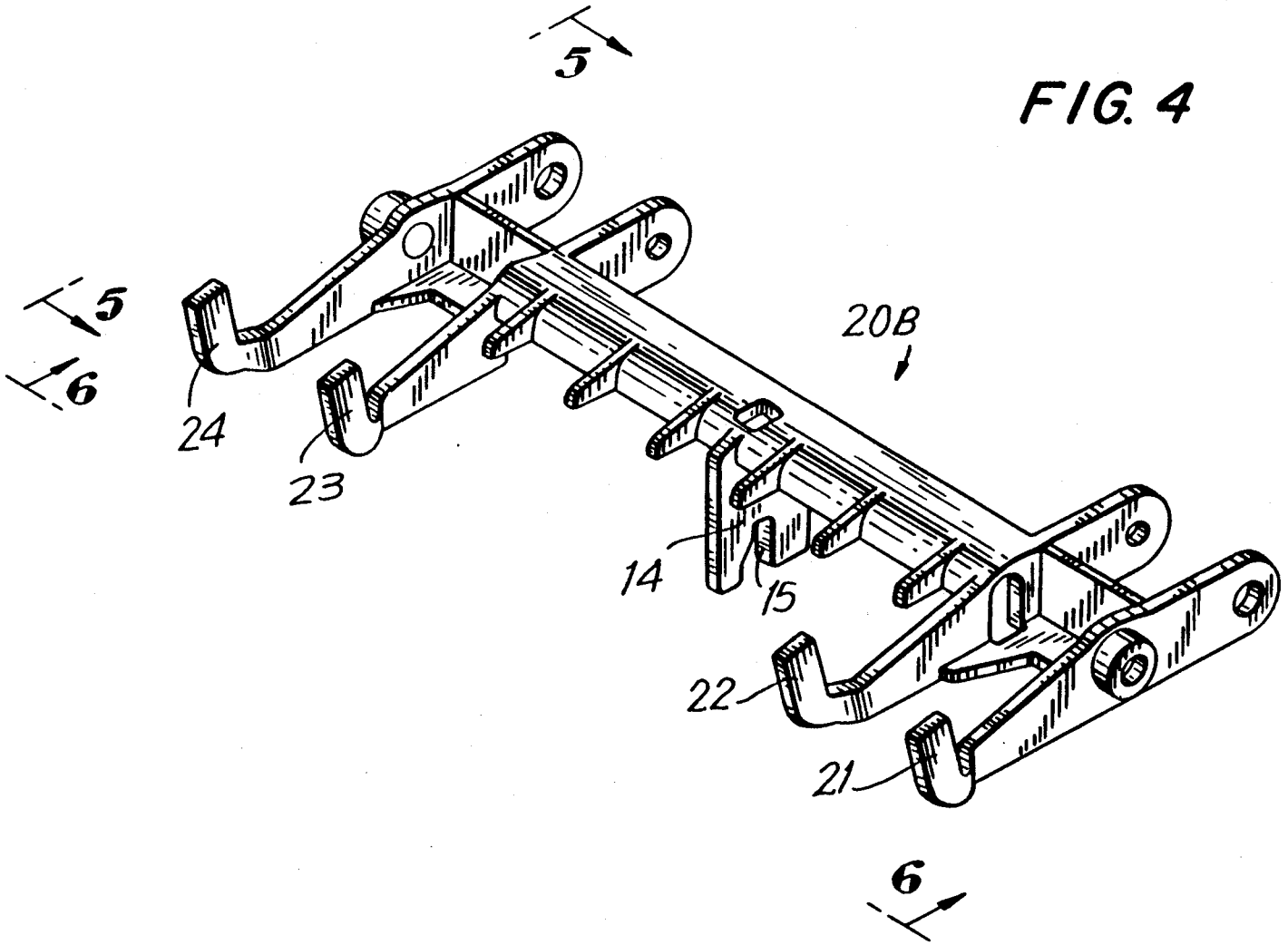
FIG. 4 is a bottom perspective view of the one-piece frame of the document registration unit of FIGS. 1-3.
Figure 5:
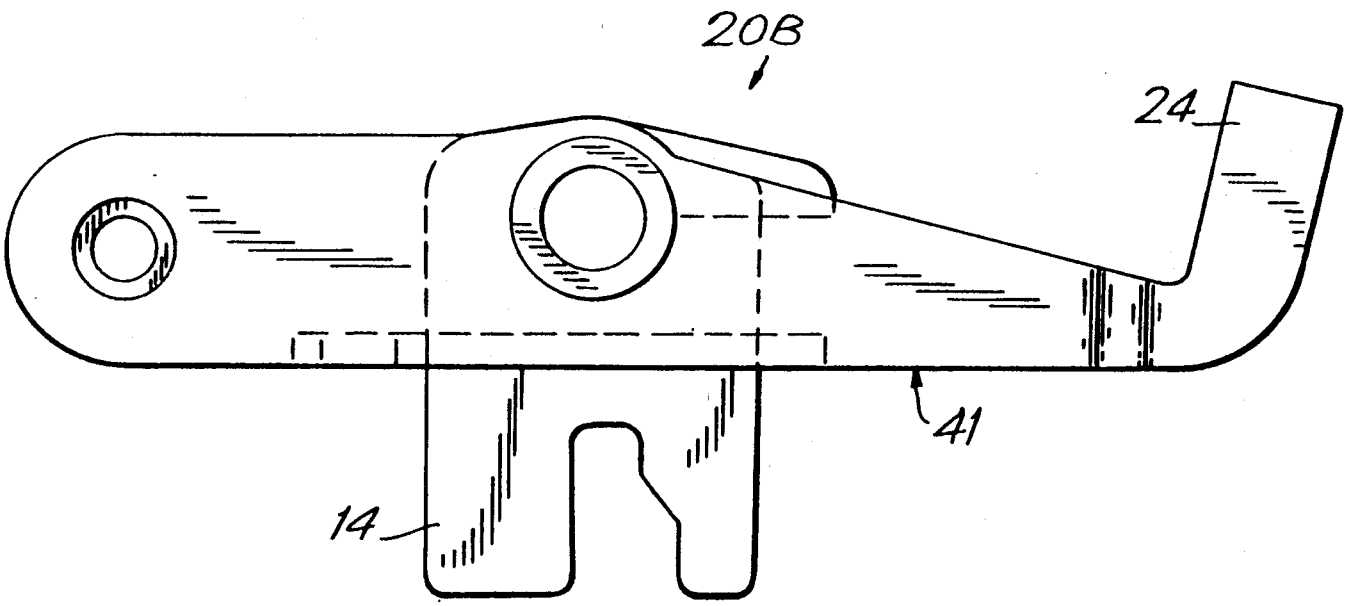
FIG. 5 is a side elevational view of the one-piece frame of FIG. 4 taken from line 5—5 of FIG. 4.
Figure 6:
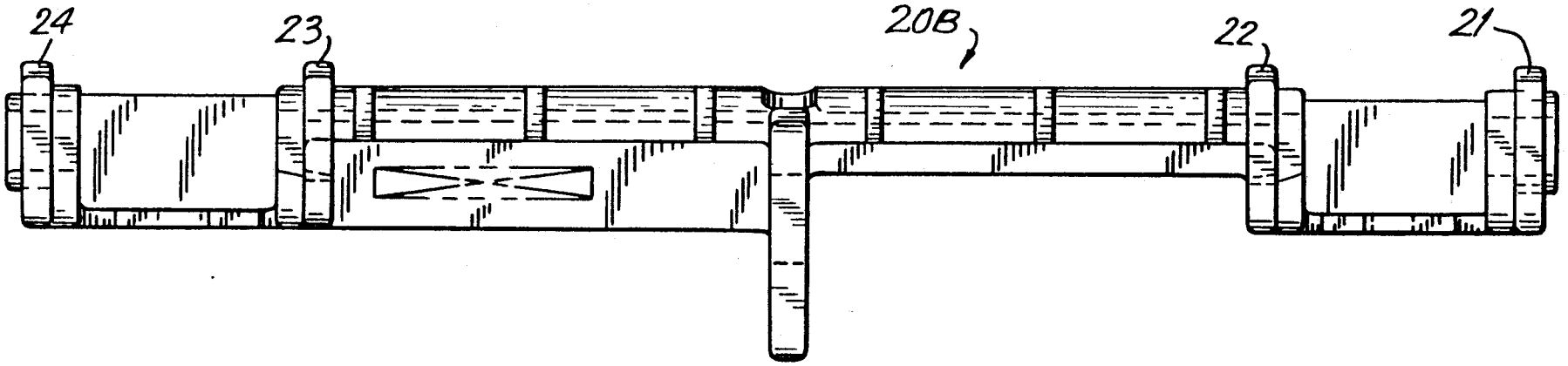
FIG. 6 is a front elevational view of the one-piece frame of FIG. 4 taken from line 6—6 of FIG. 4.
Figure 7:
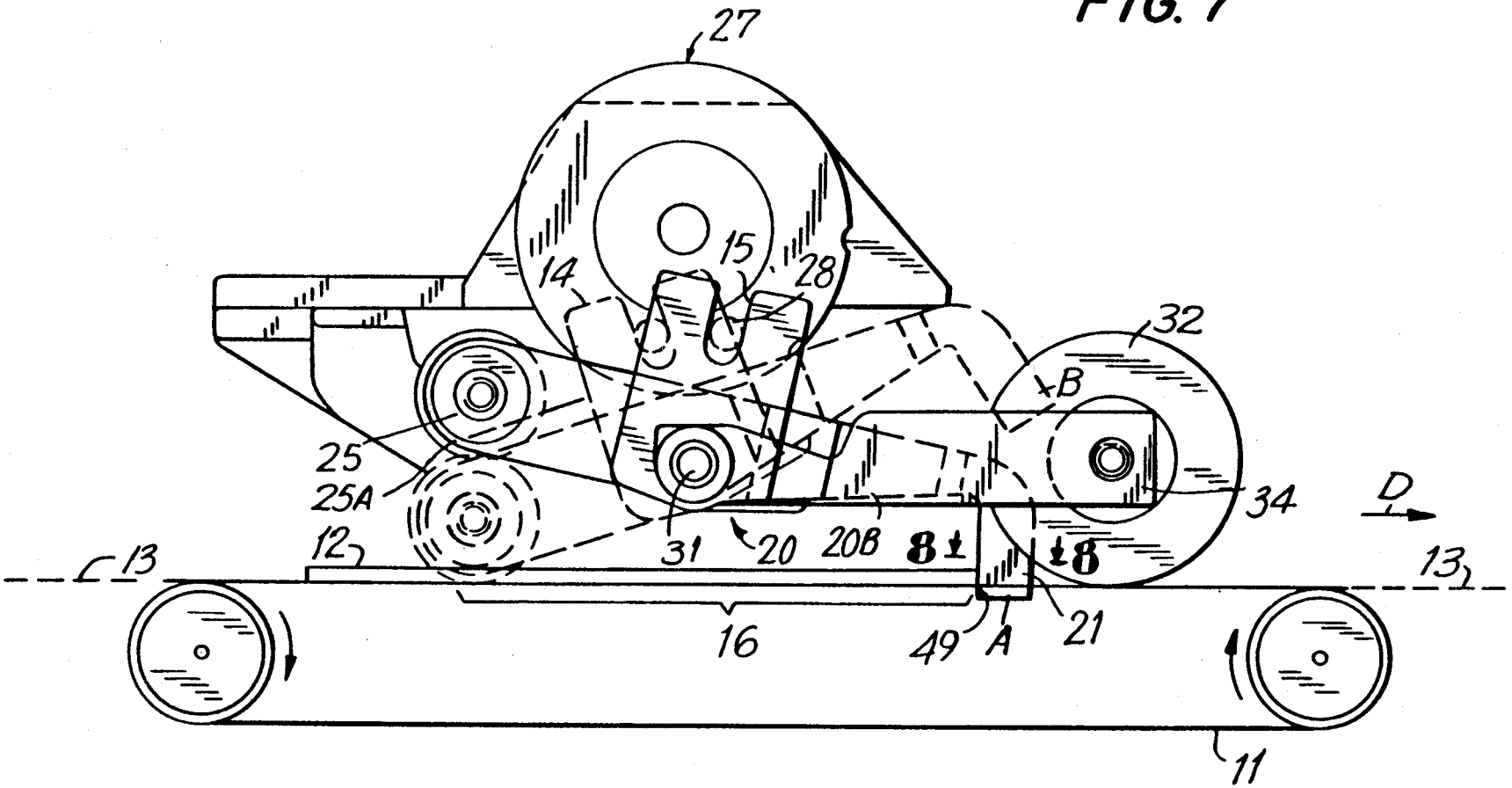
FIG. 7 is a vertical partly fragmentary partly cross-sectional view of document processing apparatus incorporating the document registration apparatus of FIGS. 1-6.
Figure 8:
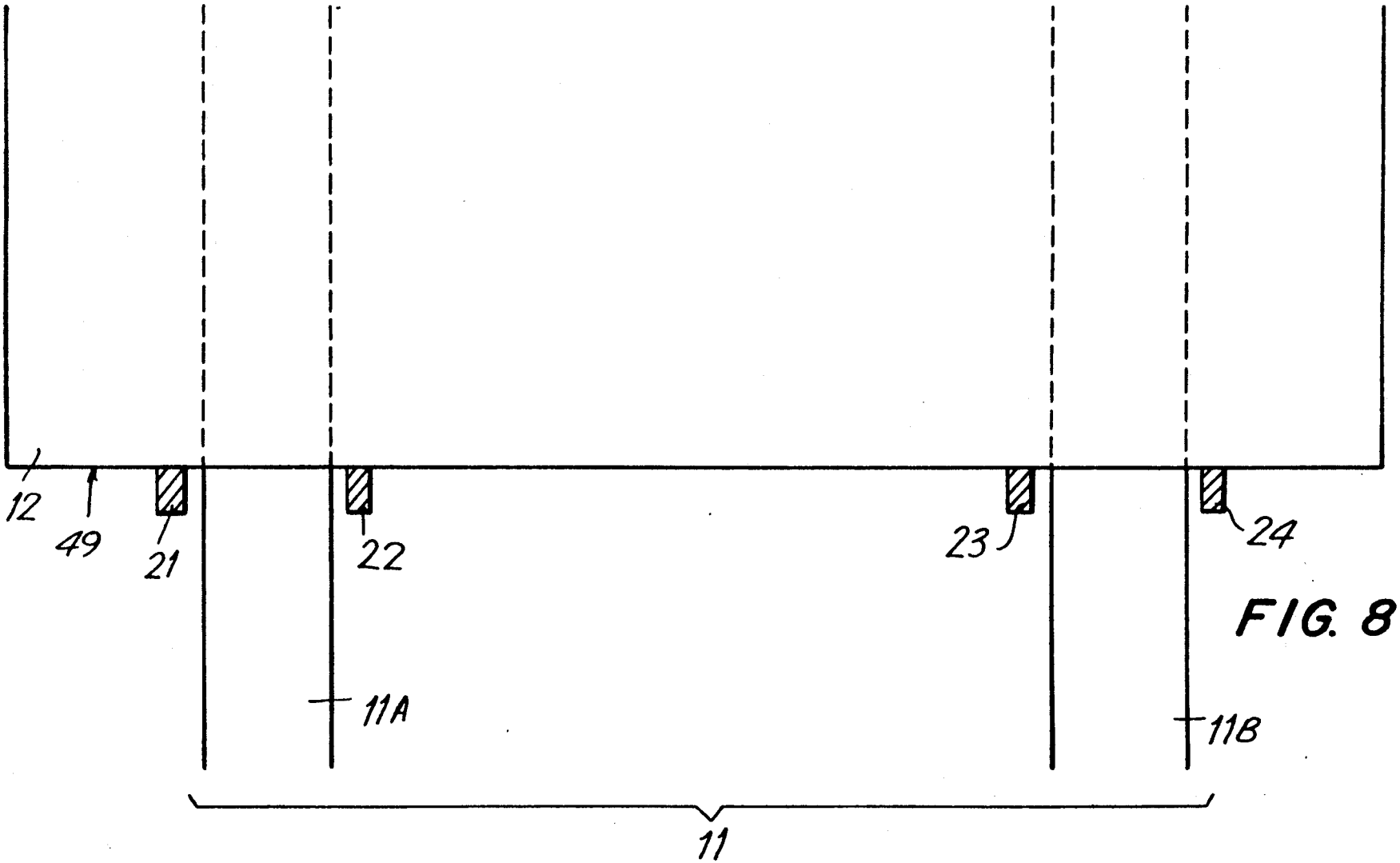
FIG. 8 is a plan view partially in section taken from line 8—8 of FIG. 7 showing the registration of a document against the registration stops of the present invention.

FIGS. 4-6 show details of the one-piece document registration frame 20B of document registration unit 20. In the preferred embodiment, unit 20 accommodates a document thickness of up to approximately 0.25 inch. While registration stops 21-24 have a length of approximately 0.45 inch (so that they project below conveyor system 11 as discussed above) and preferably form approximately a 103° angle with edge 41 of document registration frame 20B (see FIG. 5). Registration stops 21-24 are designed to extend at least approximately 0.0625 inch below the plane of conveyor system 11. Preferably, document registration frame 20B is molded from a durable material such as glass-filled polycarbonate or the like.

Figure 2:
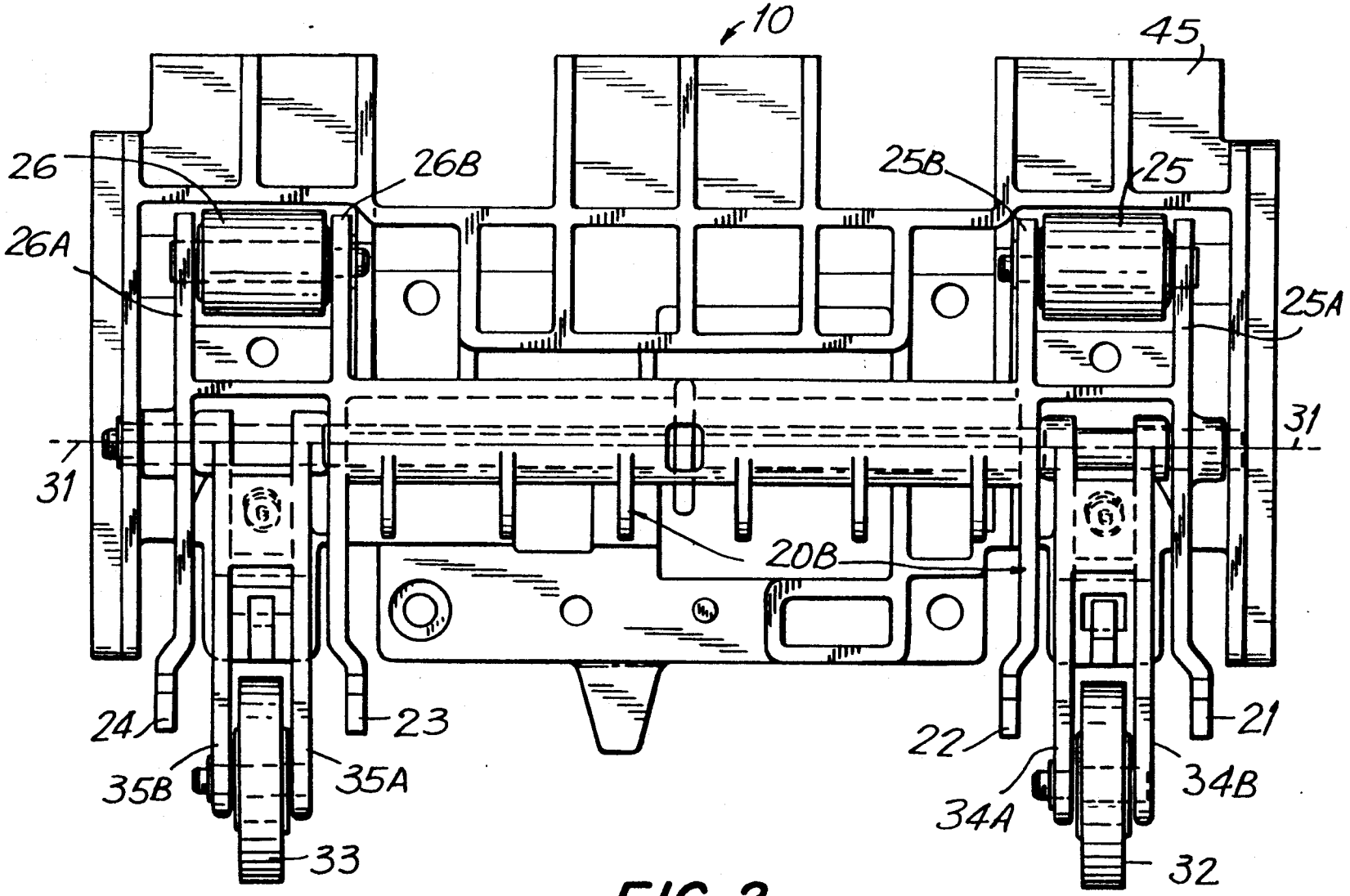
FIG. 2 is a partial cross-sectional view of the document registration apparatus of FIG. 1 taken through line 2—2 of FIG. 1.
Figure 3:
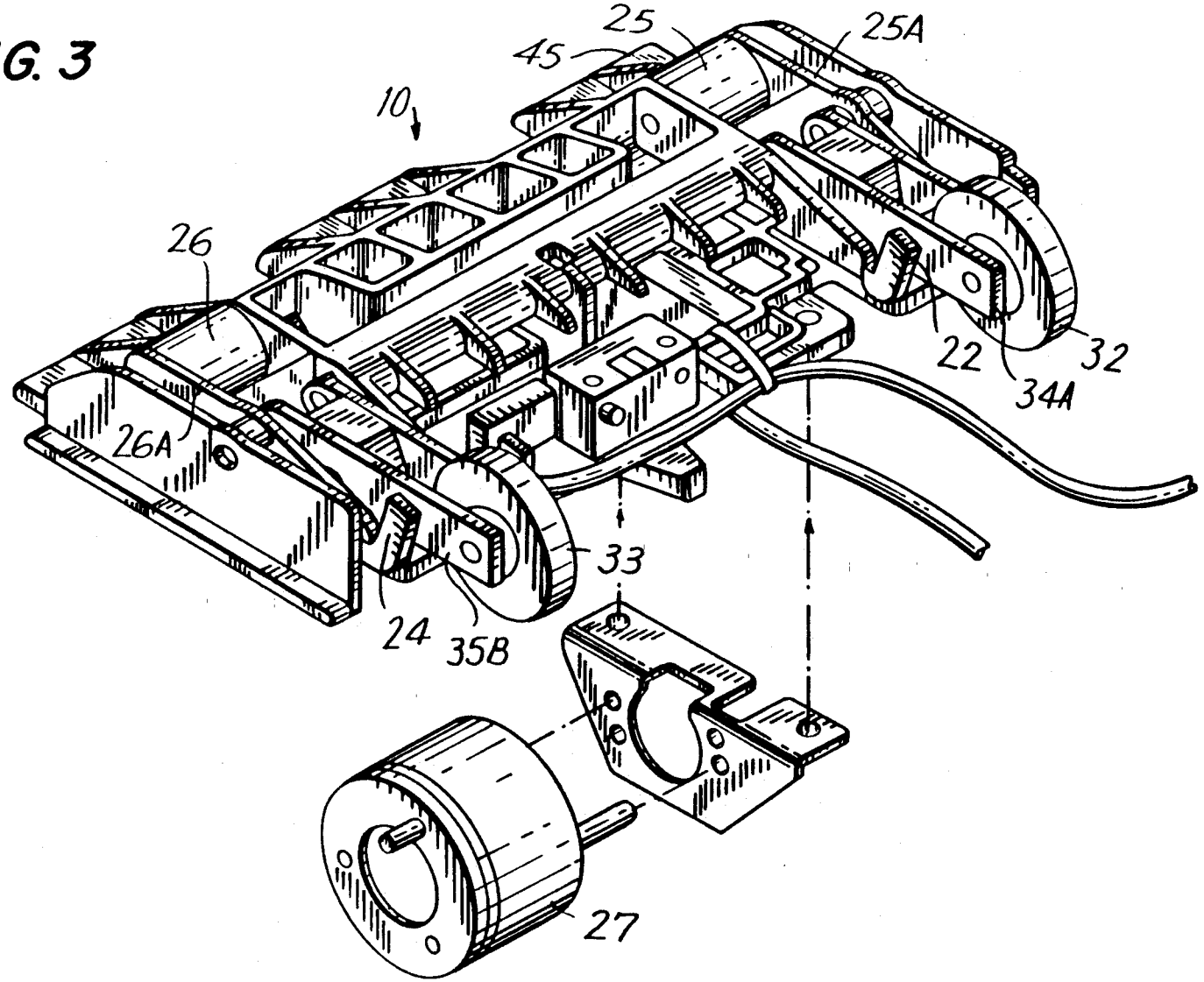
FIG. 3 is an exploded bottom perspective view of the document registration apparatus of FIG. 1 showing attachment of solenoid according to the present invention.
Figure 9:
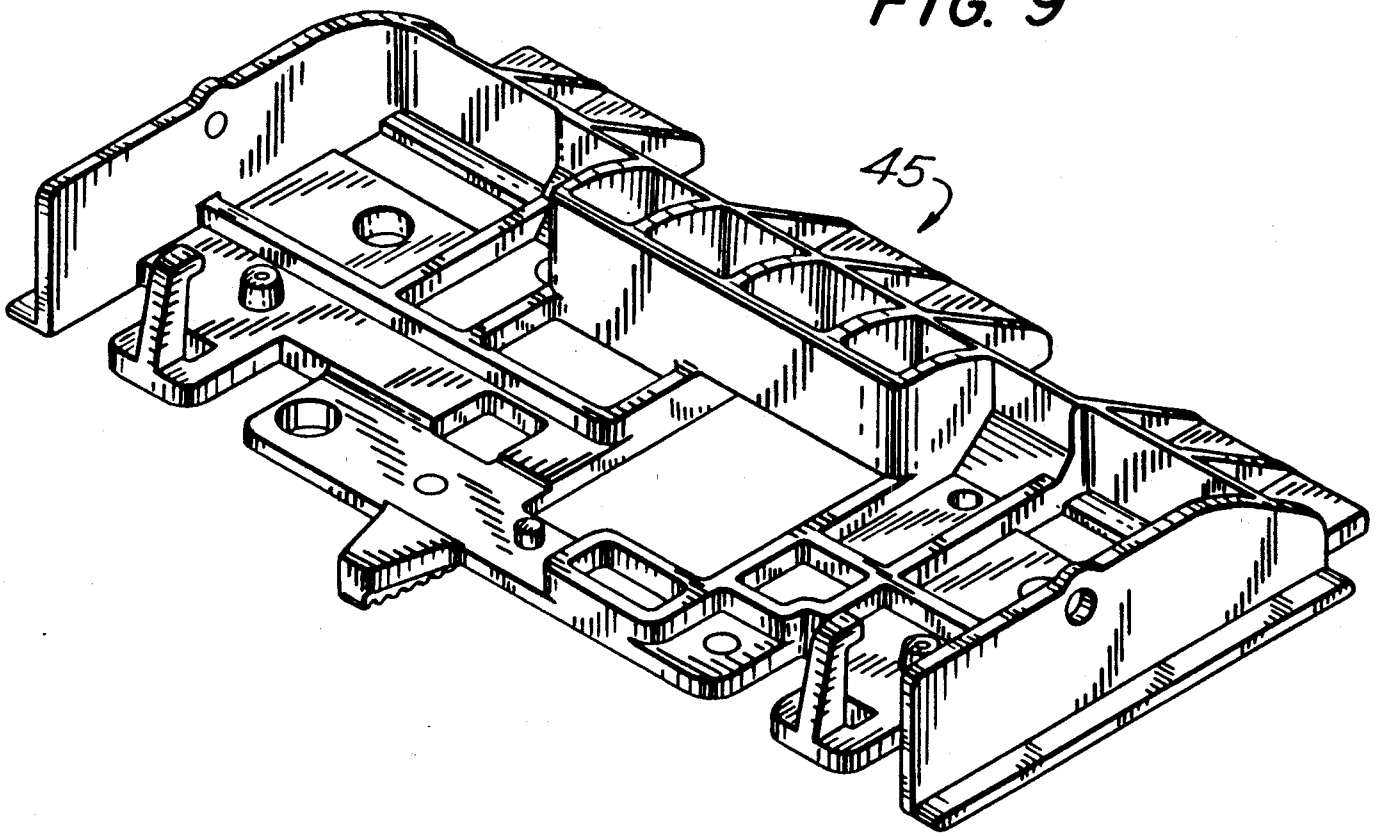
FIG. 9 is a perspective view of the document registration unit holder with which the document registration unit of the present invention is used.

As shown in FIGS. 1, 2 and 7, document registration unit 20 is preferably formed from one-piece document registration frame 20B and document registration unit holder 45, shown in detail in FIG. 9, to which frame 20B is pivotally attached. Preferably, document registration unit holder 45 is also molded from a durable material such as glass-filled polycarbonate or the like. Document registration unit holder 45 is attached, for example, to a document inserting station or a document queuing station of a document processing system.

Because document registration frame 20B is formed from a one-piece member, it is less subject to mechanical failure than registration devices formed from multiple interconnected parts. Furthermore, because registration stops 21–24 are rigidly rotationally linked to non driver urge rollers 25 and 26, it is not necessary to align registration stops 21–24 relative to non driver urge rollers 25 and 26 in order for the overall document registration apparatus to be properly aligned. Registration stops 21–24 are inherently aligned with non driver urge rollers 25 and 26 because non driver urge roller arms 25A, 26A and 26B are part of the same one-piece member as registration stops 21–24.

Figure 10:
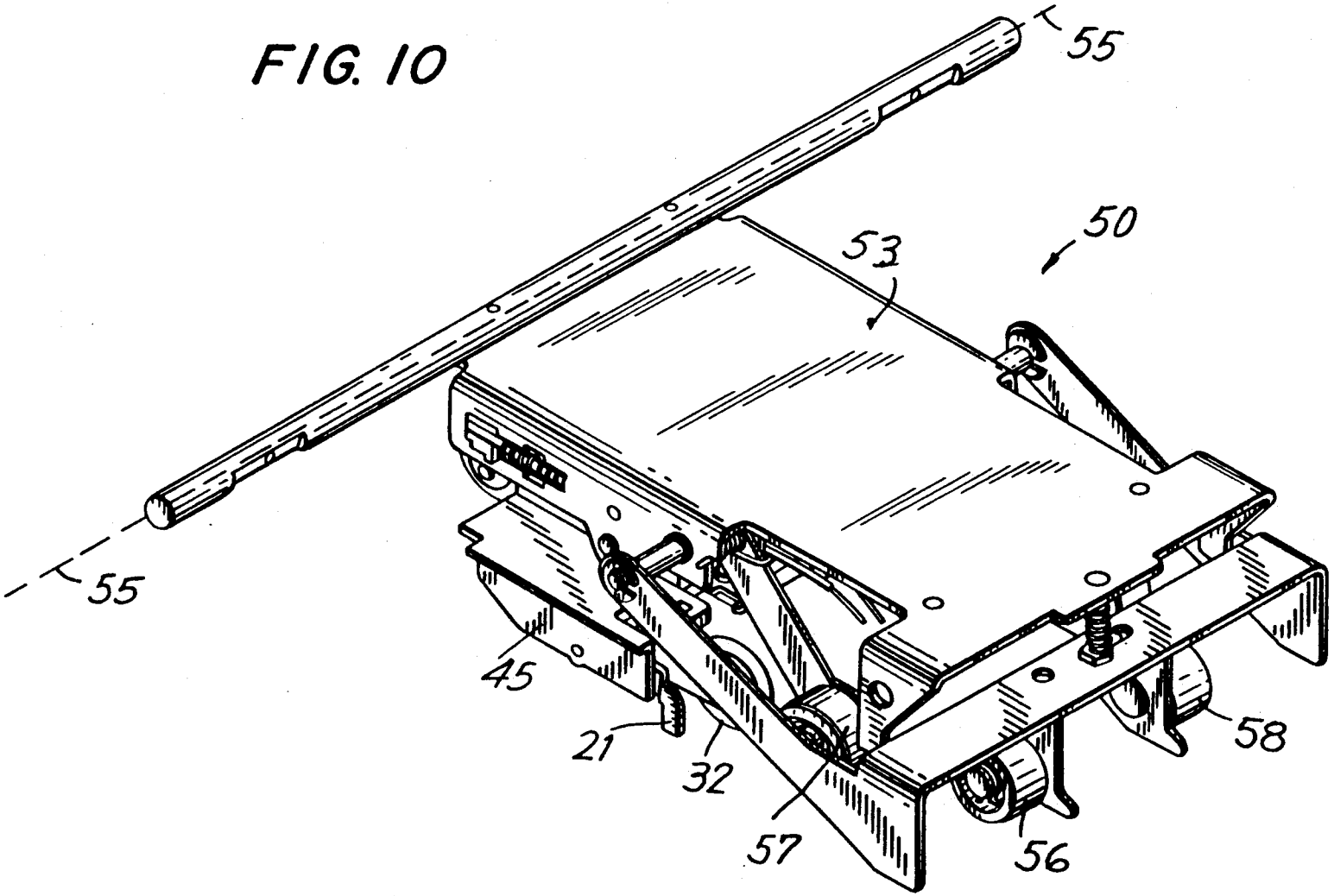
FIG. 10 is an embodiment of the present invention mounted to provide jam access.

FIG. 10 shows a second preferred embodiment 50 of the present invention where document registration apparatus 10 is mounted to provide easy access for document jams. This facilitates the removal of a document from the document processing system when it jammed in the document registration apparatus. In embodiment 50 of FIG. 10, registration stops 21–24 and non driver urge rollers 25 and 26 are connected to unit 20 as above, which in turn is attached to a frame 53 having a hinge 54 which allows movement of frame 53 about axis 55. Rollers 25, 26, 32, 33, 56, 57 and 58 all contact the system conveying means (not shown in FIG. 10) when frame 53 is in its normal operating position. However, if a document becomes jammed in apparatus 50, hinge 54 allows frame 53 to be pivoted away from the conveyor system to facilitate rapid removal of the jammed document. Apparatus 50 can be incorporated, for example, into a document inserting station or a document queuing station in a variety of document processing systems.

Thus it is seen that a document registration apparatus that has a design that does not result in frequent mechanical failure, that has minimum number of mechanical parts, that is not difficult to align, that can simultaneously align a stack of documents without shingling, and which allows easy access to jammed documents, has been provided. One skilled in the art will appreciate that the present invention can be practiced by other than the described embodiments, which are presented for purposes of illustration and not of limitation, and the present invention is limited only by the claims which follow.

What is claimed is:

1. A document registration apparatus for use with a conveying means for transporting a document along a path from an upstream direction to a downstream direction through a document registration position, a document registration unit positioned above the document path adjacent to the document registration position, having:

an upstream end, a downstream end and a pivoting axis positioned in between the upstream end and the downstream end, a plurality of laterally-spaced registration stops at the downstream end of the unit positioned substantially perpendicularly to the document path for both stopping a document at the document registration position and for aligning the document relative to the document path as the document is driven by the conveying means into the registration stops when the downstream end of the unit is pivoted adjacent to the document path, and at least one non driver urge roller at the upstream end of the unit for urging a stopped document against the conveying means when the upstream end of the unit is pivoted adjacent to the document path to move the document from the document registration position in the downstream direction; and a pivoting means for pivoting the unit about its pivoting axis for selectively moving one of the upstream end and the downstream end into a position adjacent to the document path.

2. The apparatus of claim 1 further comprising a jam access means disposed adjacent said conveying means, said jam access means allowing movement of the registration unit away from the conveying means to provide access to a jammed document at the document registration position for removal thereof.

3. The apparatus of claim 2 wherein the jam access means comprises a frame on which said unit is mounted.

4. The apparatus of claim 3 wherein said frame has a hinge about which the registration unit may be pivoted away from the conveying means.

5. The apparatus of claim 4 wherein the axis of the hinge is substantially perpendicular to the document path.

6. The apparatus of claim 1 wherein the laterally-spaced registration stops are substantially perpendicular to the document path when the downstream end of the registration unit is pivoted adjacent to the document path.

7. The apparatus of claim 1 wherein the laterally-spaced registration stops comprise two sets of two stops per set.

8. The apparatus of claim 7 wherein associated with each set of registration stops is a corresponding non driver urge roller longitudinally aligned with its corresponding set of registration stops.

9. The apparatus of claim 1 wherein for each non driver urge roller, the document registration unit further comprises two corresponding urge roller arms.

10. The apparatus of claim 9 wherein the urge roller arms and the laterally-spaced registration stops are formed from the same one-piece member.

11. The apparatus of claim 1 wherein the pivoting means comprises a solenoid.

12. The apparatus of claim 1 wherein the solenoid is a rotary solenoid.

13. The apparatus of claim 1 further comprising a plurality of exit pinch rollers positioned adjacent to and downstream from the laterally-spaced registration stops for urging a document against the conveying means in order to transport the document away from the document registration position in the downstream direction.

14. The apparatus of claim 13 wherein the exit pinch rollers are independently pivotally attached to the document registration unit pivoting axis.

* * * * *